US009845646B2

(12) United States Patent
Dahmes et al.

(10) Patent No.: US 9,845,646 B2
(45) **Date of Patent: *Dec. 19, 2017**

(54) PIPE HANDLER

(71) Applicant: Liberty Holdings, LLC., Willmar, MN (US)

(72) Inventors: Forrest L. Dahmes, New London, MN (US); Paul K. Danielson, Willmar, MN (US)

(73) Assignee: Liberty Holdings, LLC, Willmar, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/207,467

(22) Filed: Jul. 11, 2016

(65) Prior Publication Data

US 2016/0319612 A1 Nov. 3, 2016

Related U.S. Application Data

(63) Continuation of application No. 13/968,424, filed on Aug. 15, 2013, now Pat. No. 9,388,647.

(60) Provisional application No. 61/683,709, filed on Aug. 15, 2012, provisional application No. 61/814,266, filed on Apr. 20, 2013.

(51) Int. Cl.

| | |
|---|---|
| ***E21B 19/15*** | (2006.01) |
| ***E21B 19/14*** | (2006.01) |
| ***B66F 11/00*** | (2006.01) |

(52) U.S. Cl.

CPC ..... *E21B 19/155* (2013.01); *B66F 11/00* (2013.01); *E21B 19/14* (2013.01); *E21B 19/15* (2013.01)

(58) Field of Classification Search

CPC ..... E21B 19/155; E21B 7/024

USPC ..... 166/379, 380; 175/52, 85; 187/208, 210, 187/211, 215, 243, 244; 198/318, 861.3, 198/861.5; 254/112, 116; 405/198, 199; 414/22.51–22.59, 22.61–22.63; 74/519, 74/522.5

See application file for complete search history.

(56) References Cited

U.S. PATENT DOCUMENTS

| | | | |
|---|---|---|---|
| 2,577,926 | A | 12/1951 | Stiles |
| 2,628,725 | A | 2/1953 | Stone |
| 2,643,006 | A | 6/1953 | King |
| 2,880,881 | A | 4/1959 | Robishaw |
| 2,958,430 | A | 11/1960 | Robishaw |
| 3,177,944 | A | 4/1965 | Knights |

(Continued)

FOREIGN PATENT DOCUMENTS

WO WO 2014/172690 A2 10/2014

*Primary Examiner* — Gregory Adams

(74) *Attorney, Agent, or Firm* — Albert W. Watkins

(57) ABSTRACT

A pipe handler trailer assists with the handling of very large and heavy pipes that are regularly raised to and lowered from an elevated surfaces. A height adjustment assembly sets the maximum height that a skidway will reach when a lift cylinder is fully extended and lift arms are thereby rotated. Located within lift arms are toothed racks. An adjustment block couples the skidway to lift arms through the racks and also supports locking blocks that have teeth complementary to the teeth on the racks. A lock will vary from firm contact with the inner wall of lift arms to having a gap there between. When the lock engages the inner wall of the lift arm this drives the complementary teeth into secure engagement with the rack teeth, which can then rigidly support heavy load without motion.

20 Claims, 10 Drawing Sheets

(56) References Cited

U.S. PATENT DOCUMENTS

| | | | |
|---|---|---|---|
| 3,212,593 | A | 10/1965 | Reischl |
| 3,259,368 | A | 7/1966 | Warnke |
| 3,280,920 | A | 10/1966 | Scott |
| 3,539,024 | A | 11/1970 | Irons et al. |
| 3,559,821 | A | 2/1971 | James |
| 3,616,941 | A | 11/1971 | Walling |
| 3,633,771 | A | 1/1972 | Woolslayer et al. |
| 3,706,347 | A | 12/1972 | Brown |
| 3,716,149 | A | 2/1973 | Scaggs |
| 3,734,208 | A | 5/1973 | Otto |
| 3,743,078 | A | 7/1973 | Pittoreau |
| 3,750,804 | A | 8/1973 | Lemelson |
| 3,774,780 | A | 11/1973 | Buffington |
| 3,792,783 | A | 2/1974 | Brown |
| 3,810,553 | A | 5/1974 | Crocker et al. |
| 3,916,500 | A | 11/1975 | Brown |
| 3,937,334 | A | 2/1976 | Bleyl et al. |
| 3,991,887 | A | 11/1976 | Trout |
| 4,040,524 | A | 8/1977 | Lamb et al. |
| 4,053,063 | A | 10/1977 | Harper, Jr. |
| 4,081,087 | A | 3/1978 | Freeman, Sr. |
| 4,082,193 | A | 4/1978 | Teague |
| 4,134,501 | A | 1/1979 | Tune |
| 4,140,227 | A | 2/1979 | Beck |
| 4,235,566 | A | 11/1980 | Beeman et al. |
| 4,255,069 | A | 3/1981 | Yielding |
| 4,368,602 | A | 1/1983 | Manten |
| 4,386,883 | A | 6/1983 | Hogan et al. |
| 4,403,898 | A | 9/1983 | Thompson |
| 4,439,091 | A | 3/1984 | Frias |
| 4,453,872 | A | 6/1984 | Frias et al. |
| 4,492,502 | A | 1/1985 | Delano |
| 4,494,899 | A | 1/1985 | Hoang et al. |
| 4,684,314 | A | 8/1987 | Luth |
| 4,815,712 | A | 3/1989 | Kawada |
| 5,012,898 | A | 5/1991 | Tsymberov |
| 5,190,122 | A | 3/1993 | Fletcher et al. |
| 5,915,882 | A | 6/1999 | Darwiche et al. |
| 6,079,925 | A | 6/2000 | Morgan et al. |
| 6,899,510 | B2 | 5/2005 | Morelli et al. |
| 7,021,880 | B2 | 4/2006 | Morelli et al. |
| 7,163,367 | B2 | 1/2007 | Handley |
| 7,473,065 | B2 | 1/2009 | Wells |
| 7,635,249 | B2 | 12/2009 | Guidroz |
| 7,665,944 | B2 | 2/2010 | Guidroz |
| 7,744,327 | B2 | 6/2010 | Lops et al. |
| 7,992,646 | B2 | 8/2011 | Wright et al. |
| 8,052,368 | B2 | 11/2011 | Littlewood et al. |
| 9,388,647 | B2 * | 7/2016 | Dahmes ..... E21B 19/14 |
| 2004/0136813 | A1 | 7/2004 | Pietras |
| 2005/0079044 | A1 | 4/2005 | Handley |
| 2008/0263990 | A1 | 10/2008 | Morelli et al. |
| 2009/0272235 | A1 | 11/2009 | Berry |
| 2014/0238745 | A1 | 8/2014 | Dahmes et al. |

* cited by examiner

PIPE HANDLER

CROSS REFERENCE TO RELATED APPLICATIONS

This application claims the benefit under 35 USC 119(e) of provisional application No. 61/683,709 filed Aug. 15, 2012 herewith of like title and inventorship, and also claims the benefit under 35 USC 119(e) of provisional application No. 61/814,266 filed Apr. 20, 2013 herewith of like title and inventorship, the entire contents of each which are incorporated herein by reference in entirety.

BACKGROUND OF THE INVENTION

1. Field of the Invention

This invention pertains generally to material or article handling, and more particularly to a pipe handler such as might commonly be used in the oil drilling and rigging industry to assist with the handling of very large and heavy pipes that are regularly raised to and lowered from an elevated drilling platform.

2. Description of the Related Art

In the oil drilling and rigging industry, drilling platforms commonly referred to as derricks are assembled above the earth. These derricks facilitate the drilling and installation of wells. The platform or work floor typically may be elevated many feet above the ground.

Drill strings of very large and heavy pipes are assembled or disassembled on the derrick. For exemplary and non-limiting purposes, these pipes may be stored horizontally on or near the ground adjacent to the derrick. This means that these very large and heavy pipes must be re-oriented from horizontal to more nearly vertical orientation, and raised from near ground level to several tens of feet into the air. Consequently, the handling of these large and heavy pipes is not suited to manual labor, and instead requires mechanical assistance.

Pipe handlers are commonly be used to assist with the handling of these very large and heavy pipes that are regularly raised and lowered from an elevated drilling platform. A large number of patents are exemplary of this technology, and provide the background for the basic features, while also contrasting with the novel features of the present invention. These U.S. patents, the contents and teachings which are incorporated herein by reference, include: U.S. Pat. No. 2,643,006 by King, entitled "Automatic pipe handler," that illustrates an early automatic pipe handler, and describes a bumper or stop having a resilient portion in the form of a rubber or spring against which the drill pipe may abut, that prevents a pipe section from sliding down the dolly. U.S. Pat. No. 3,792,783, entitled "Pipe Handling System" and U.S. Pat. No. 3,916,500 entitled "Pipe handling apparatus", each by Cicero C. Brown, the contents and teachings which are incorporated herein by reference, describe another early automatic pipe handler having an endless cable or chain driving a lug to elevate a pipe in a trough to push the pipe toward the derrick. This same lug is also used to control the rate of descent of the pipe. U.S. Pat. No. 4,386,883 by Hogan et al, entitled "Materials lifting apparatus" and U.S. Pat. No. 4,494,899 by Hoang et al, entitled "Pipe trough for transporting pipe between upper and lower positions", the contents and teachings which are incorporated herein by reference, each describe automatic pipe handlers with kickers to assist with the loading and unloading of pipes. Hogan refers to these kickers as pipe ejecting assemblies that eject the pipe from the carriage using an arm and a ram, and Hoang et al refers to these as unloading arms for ejecting the pipe from the trough. Hoang et al also describe pipe loading arms to assist with loading pipe into the trough. U.S. Pat. No. 4,235,566 by Beeman et al, entitled "Pipe-conveying catwalk" and U.S. Pat. No. 4,439,091 by Frias, entitled "Pipe feeding system", the contents and teachings which are incorporated herein by reference, each illustrate carriages that move along a trough. The teachings and content of U.S. Pat. No. 3,559,821 by James, entitled "Drill Pipe Handling Apparatus" and which illustrates another drill pipe handling apparatus, is additionally incorporated herein by reference.

Additional U.S. patents illustrating various kicker constructions, the teachings and contents which are incorporated herein by reference, include: U.S. Pat. No. 4,140,227 by Beck, entitled "Cable way apparatus for transporting pipe"; and U.S. Pat. No. 4,403,898 by Thompson, entitled "Pipe pick-up and laydown machine". Additional patents showing rigid pipe handler structures, the teachings and contents which are incorporated herein by reference, include: U.S. Pat. No. 2,880,881 by Robishaw, entitled "Unitized pipe rack"; U.S. Pat. No. 2,958,430 by Robishaw, entitled "Pipe rack and lay-down trough"; U.S. Pat. No. 4,684,314 by Luth, entitled "Pipe handling apparatus"; U.S. Pat. No. 6,079,925 by Morgan et al, entitled "Method and apparatus for lifting oilfield goods to a derrick floor"; U.S. Pat. No. 7,635,249 by Guidroz, entitled "Pipe pick-up and laydown apparatus"; U.S. Pat. No. 7,665,944 by Guidroz, entitled "Pipe pick-up and laydown apparatus and method"; U.S. Pat. No. 7,992,646 by Wright et al, entitled "Horizontal offline stand building system"; and U.S. Pat. No. 8,052,368 by Littlewood et al, entitled "Catwalk for a drilling rig". Other relevant patents and published applications, the teachings and contents which are incorporated herein by reference, include: U.S. Pat. No. 6,899,510 by Morelli et al, entitled "Pipe handling system for presenting sections of pipe to a derrick work floor having a pipe ejection assembly"; U.S. Pat. No. 7,021,880 by Morelli et al, entitled "Pipe handling apparatus for presenting sections of pipe to a derrick work floor having a high-speed carriage assembly"; U.S. Pat. No. 7,163,367 by Handley, entitled "Multi-position height adjustment system for a pipe handling apparatus"; and 2008/0263990 by Morelli et al, entitled "Skidding system for a catwalk". The Handley patent illustrates one technique for adjusting the height of the boom on an automatic pipe handler. In Handley, a plurality of boom ports and arm ports are provided, and one boom port is linked to one arm port through a hinge pin. Thee particular selection made by the hinge pin determines the height of the boom.

From these foregoing patents, the basic structure of a pipe handler and the function thereof will be well understood. In addition to the foregoing patents, Webster's New Universal Unabridged Dictionary, Second Edition copyright 1983, is incorporated herein by reference in entirety for the definitions of words and terms used herein.

SUMMARY OF THE INVENTION

The present invention provides a novel height adjustment assembly to set the maximum height that the skidway or trough, also sometimes referred to as the boom, will reach when the hydraulic lift cylinder is fully extended.

In a first manifestation, the invention is a pipe handler having a height adjustment assembly to set an adjustable maximum height that a skidway will reach above a deck when a hydraulic lift cylinder is extended. A supporting carriage supports at least a first end of the skidway. A lift arm is pivotally coupled to the supporting carriage adjacent a first terminus and is pivotal with respect to the supporting carriage about an axis transverse to a longitudinal axis of the skidway. An internal rack is fixed within the lift arm. An adjustment block couples the internal rack to the skidway. A locking block is coupled to the adjustment block and is operative to rigidly engage with the internal rack when the skidway is displaced from the deck, and thereby prevent relative movement of the adjustment block relative to the internal rack. A drive is operative to reposition the adjustment block longitudinally along the skidway and thereby alter the maximum height that the skidway will reach when the hydraulic lift cylinder is extended.

BRIEF DESCRIPTION OF THE DRAWINGS

The objects, advantages, and novel features of the present invention can be understood and appreciated by reference to the following detailed description of the invention, taken in conjunction with the accompanying drawings, in which.

DESCRIPTION OF THE PREFERRED EMBODIMENT

Figure 1:
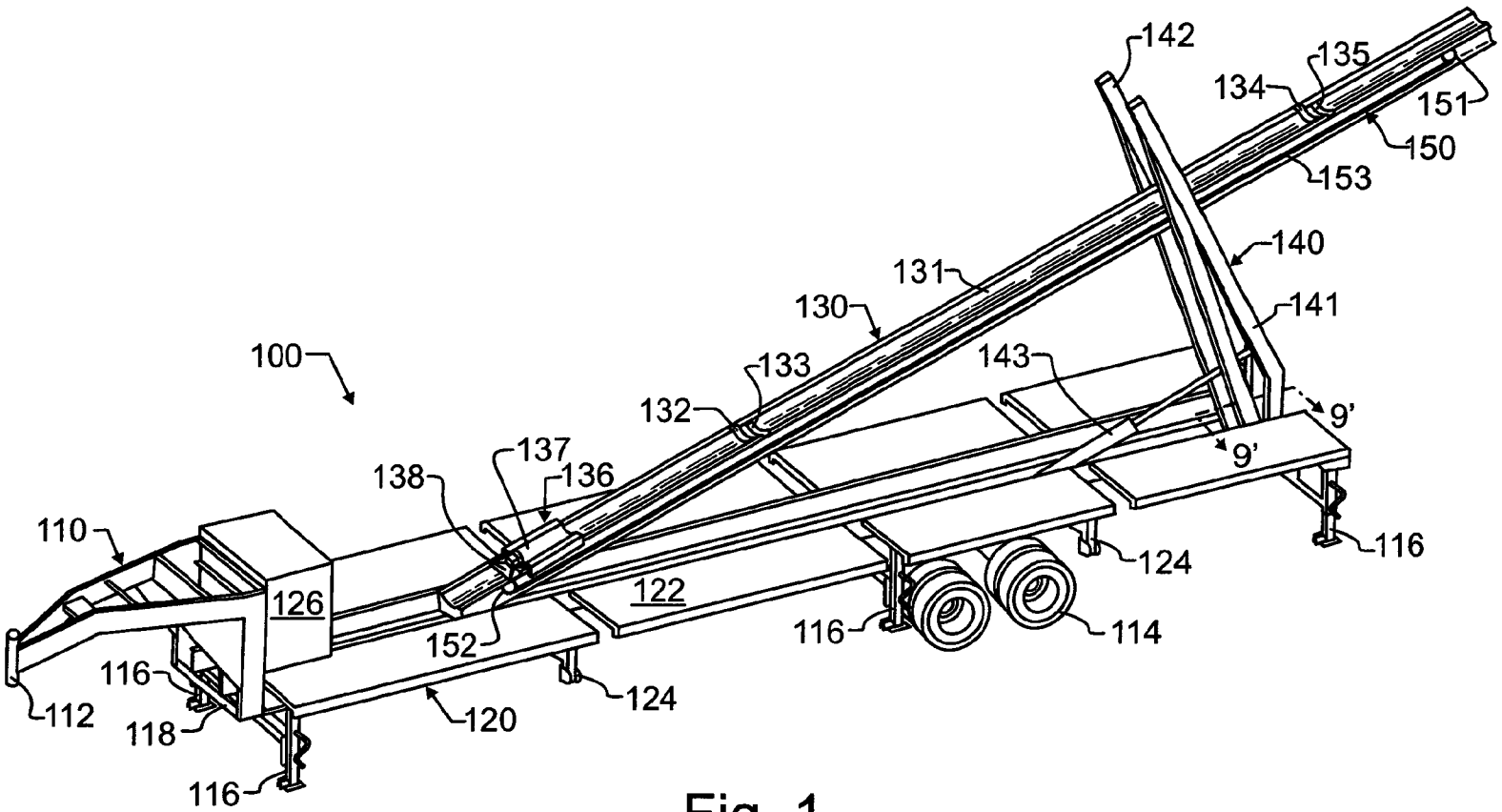
FIG. 1 illustrates a preferred embodiment pipe handler designed in accord with the teachings of the present invention from a projected view.

Manifested in the preferred embodiment, the present invention provides a pipe handler trailer 100 for use in the oil drilling and rigging industry and other appropriate industries to assist with the handling of very large and heavy pipes that are regularly raised to and lowered from an elevated surface such as a drilling platform. While a trailer is not critical to the operation of the invention, and so the pipe handler apparatus could conceivably be provided on a self-propelled vehicle such as a truck, or alternatively provided on a fixed structure without wheels, the provision of various trailer components such as a tongue assembly 110 with hitch 112, wheels 114, support legs 116, and trailer undercarriage 118 illustrated in FIG. 1 allow the preferred embodiment pipe handler trailer 100 to be transported conveniently to more than one drilling derrick. If a self-propelled vehicle such as truck were used, then the capital investment in the drive train and cab is tied up in the apparatus, and, since the pipe handler may be left at a single platform for extended periods, the drive train and cab are unavailable for use. Instead, the preferred embodiment pipe handler trailer 100 may be quickly anchored by dropping support legs 116, which will preferably be independently adjustable to accommodate uneven surfaces, and then quickly disconnecting hitch 112 from a towing vehicle. The towing vehicle is then free for other productive use.

Trailer top 120 includes a deck 122 which in the preferred embodiment may be provided with one or more small gaps within which are provided pick-up and indexing arms 124 that facilitate the loading of pipes onto deck 122. A motor, hydraulic pump and associated controls and components may be provided in power box 126, though any suitable source of energy and motive power may be provided within the constraints of the present invention.

In accord with the teachings of the present invention, a novel height adjustment assembly is used to set the maximum height that the skidway or trough 130, also sometimes referred to as the boom, will reach when a hydraulic lift cylinder 143 is fully extended. When stored, such as during periods of non-use or during transport, skidway 130 will preferably nest within deck 122. Likewise, when a pipe is being loaded from deck 122 into trough 131, skidway 130 will also be lowered and nested within deck 122.

Figure 2:
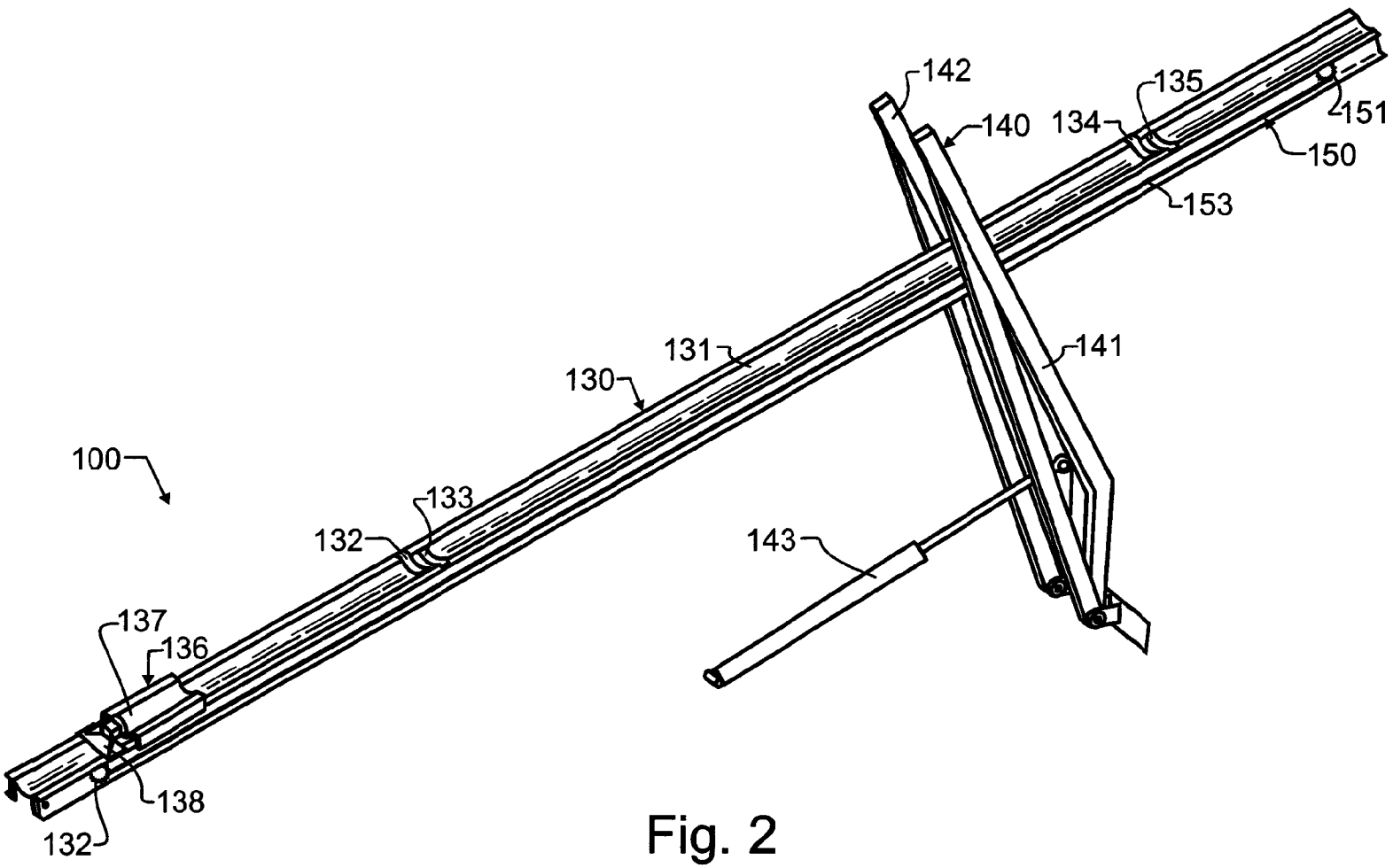
FIG. 2 illustrates the preferred skidway and lift arms incorporated in the preferred embodiment pipe handler of FIG. 1 from an enlarged, projected view with extraneous components hidden from view.

In the preferred embodiment pipe handler trailer 100 illustrated in FIGS. 1-5, the elevation of the skidway, whether nested within deck 122 or angled upward and rearward therefrom, is controlled by boom lift 140. Boom lift 140 incorporates a pair of lift arms 141, 142 that are pivotally mounted onto the trailer undercarriage 118 adjacent the back end or rear of pipe handler trailer 100. Lift arms 141, 142 pivot about an axis transverse to the longitudinal axis of the trailer, and the amount of pivot is controlled by hydraulic lift cylinder 143. As lift arms 141, 142 raise in a clockwise direction as seen in FIGS. 1 and 2 from a stored or lowermost position parallel to the trailer longitudinal axis, they carry skidway 130 both rearwardly along the trailer longitudinal axis, and also raise the rearward most point of skidway 130 significantly above deck 122. Note that the forward most point of skidway 130 stays much closer to deck 122, regardless of the pivotal orientation of lift arms 141, 142.

Skidway 130 includes a trough 131 for receiving and holding a pipe during conveyance. This trough may be sized for a single pipe diameter, but will more typically be dimensioned to support the largest pipe for which the pipe handler trailer 100 is designed to accommodate. Various apparatus known in the art may optionally be provided to better secure, retain or hold pipes, whether the maximum size or smaller, safely in the trough, including various hoops, covers or the like.

In preferred embodiment pipe handler trailer 100, and most visible in FIG. 2, located intermediate along skidway 130 are a plurality of flippers or kickers 132-135 that are operative to kick a pipe out of trough 131. Kickers may preferably be provided in pairs, such as 132, 133. In such case, kicker 132 may preferably be used to flip the pipe to a first side of the trailer herein identified as the passenger side, which corresponds to the side of the towing vehicle a passenger in the front seat would be seated. In this case, kicker 133 for exemplary purposes will flip the pipe to the opposite or driver's side of the trailer. While the exact number and placement of kickers is not critical to the invention, providing at least two pairs of kickers at distal locations along trough 131 helps to ensure smooth discharge of pipes from the trough.

Adjacent to the forward end of the trailer and positioned to roll along the top surface of trough 131 is skate 136. Skate 136 may preferably be provided with a cradle 137 which holds one end of a pipe, and also with a backstop 138 which preferably rises above cradle 137 to engage the end of a pipe along a transverse plane. This allows skate 136 to cradle and move a pipe along trough 131, to raise or lower the pipe relative to trailer deck 122.

Skate 136 is driven longitudinally along trough 131 by a drive 150, which in the preferred embodiment pipe handler trailer 100 is an endless chain 153 wrapping at distal ends of trough 131 about sprockets 151, 152. At least one of sprockets 151, 152 will be connected to a source of motive power, such as through a hydraulic coupling back to power box 126, though once again, any suitable source of motive power may be used. Furthermore, other methods and apparatus may be used to move skate 136 longitudinally along trough 131.

Figure 3:
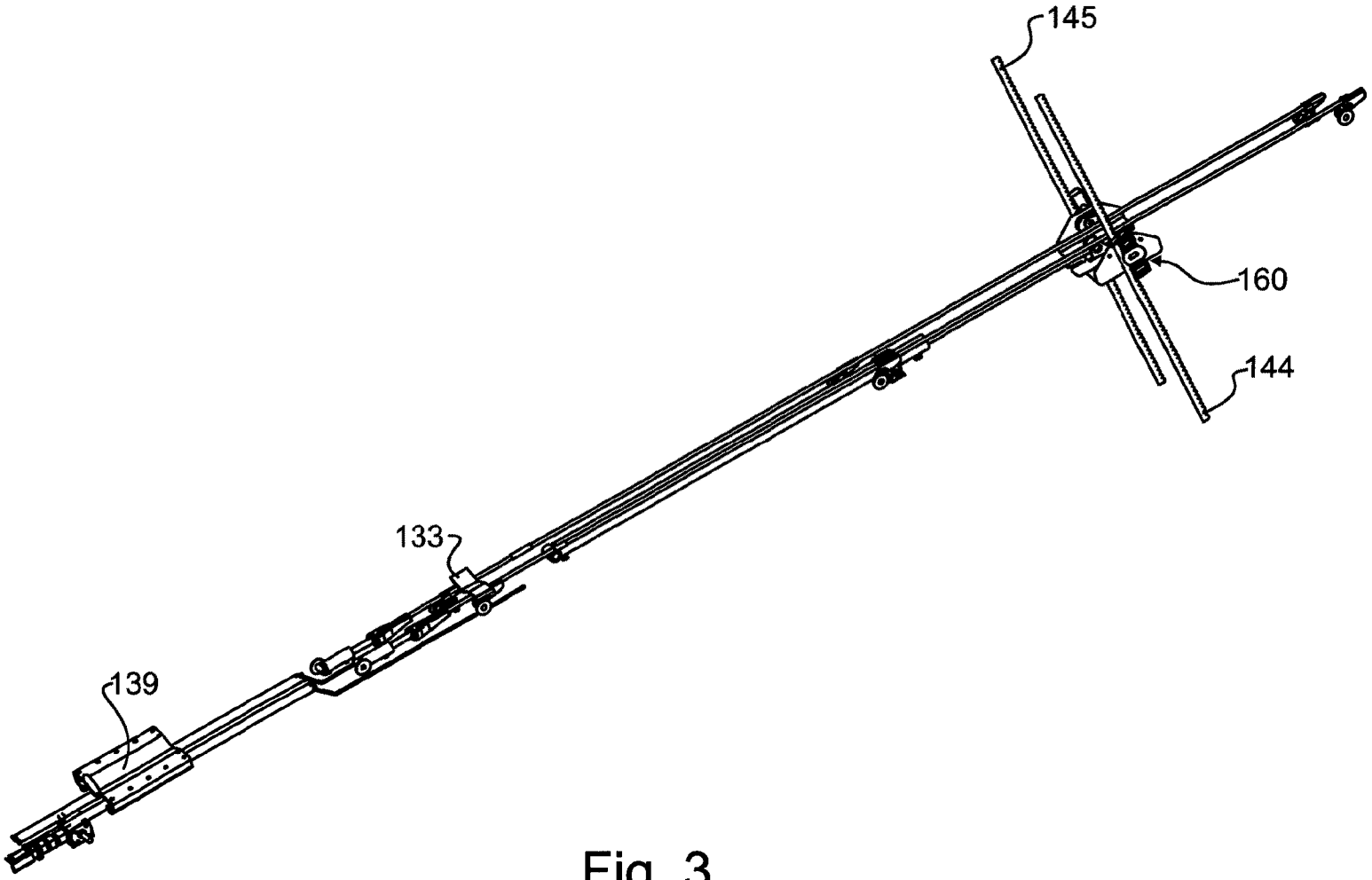
FIG. 3 illustrates selected interior components incorporated in the preferred skidway and lift arms of FIG. 2 from a similar enlarged, projected view.

FIG. 3 illustrates selected interior components incorporated in the preferred skidway and lift arms of FIG. 2, with the size and viewing angle maintained to be similar to FIG. 2 to allow inspection and comparison there between. Skate underbody 139 is illustrated therein, to give perspective on component location. Further towards lift arms 141, 142 is a single kicker 133, once again to maintain perspective. Surrounding kicker 133 is structure which operates through a plunging motion to activate kickers 132-135, though the structure used for such activation is not important to the present invention, and prior art methods and apparatus incorporated herein above by reference may also be used.

Located within lift arms 141, 142 are toothed racks 144, 145, respectively. The arrangement of lift arm 141 within rack 144 is visible in FIG. 5, with it understood that each rack will be rigidly fastened or affixed to the associated lift arm. This may be through removable or permanent fastening techniques, as will be determined by one skilled in the art of fabrication.

Figure 4:
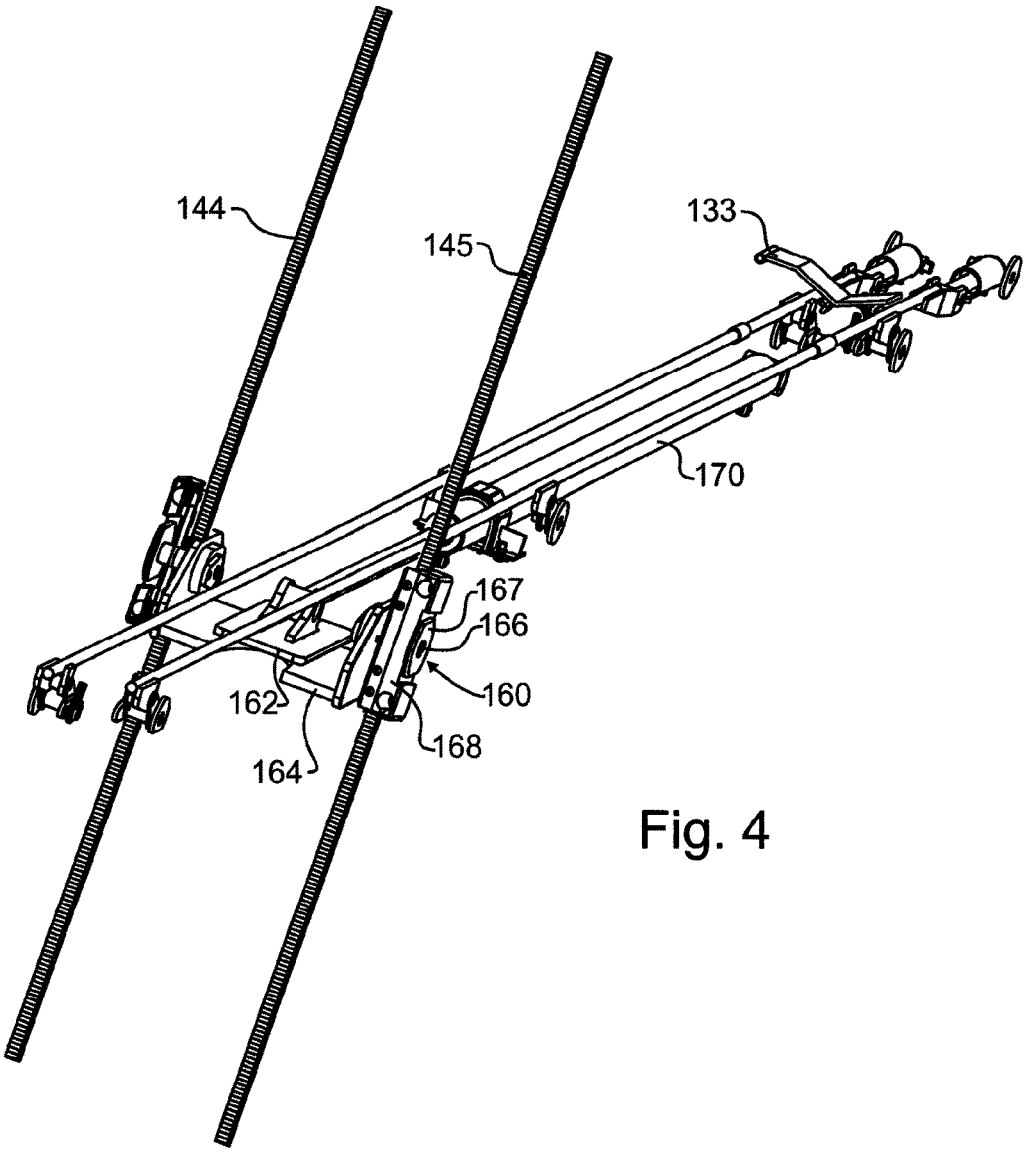
FIG. 4 illustrates selected interior components incorporated in the preferred skidway and lift arms of FIG. 2 from a rotated, enlarged, projected view better illustrating the internal racks.
Figure 5:
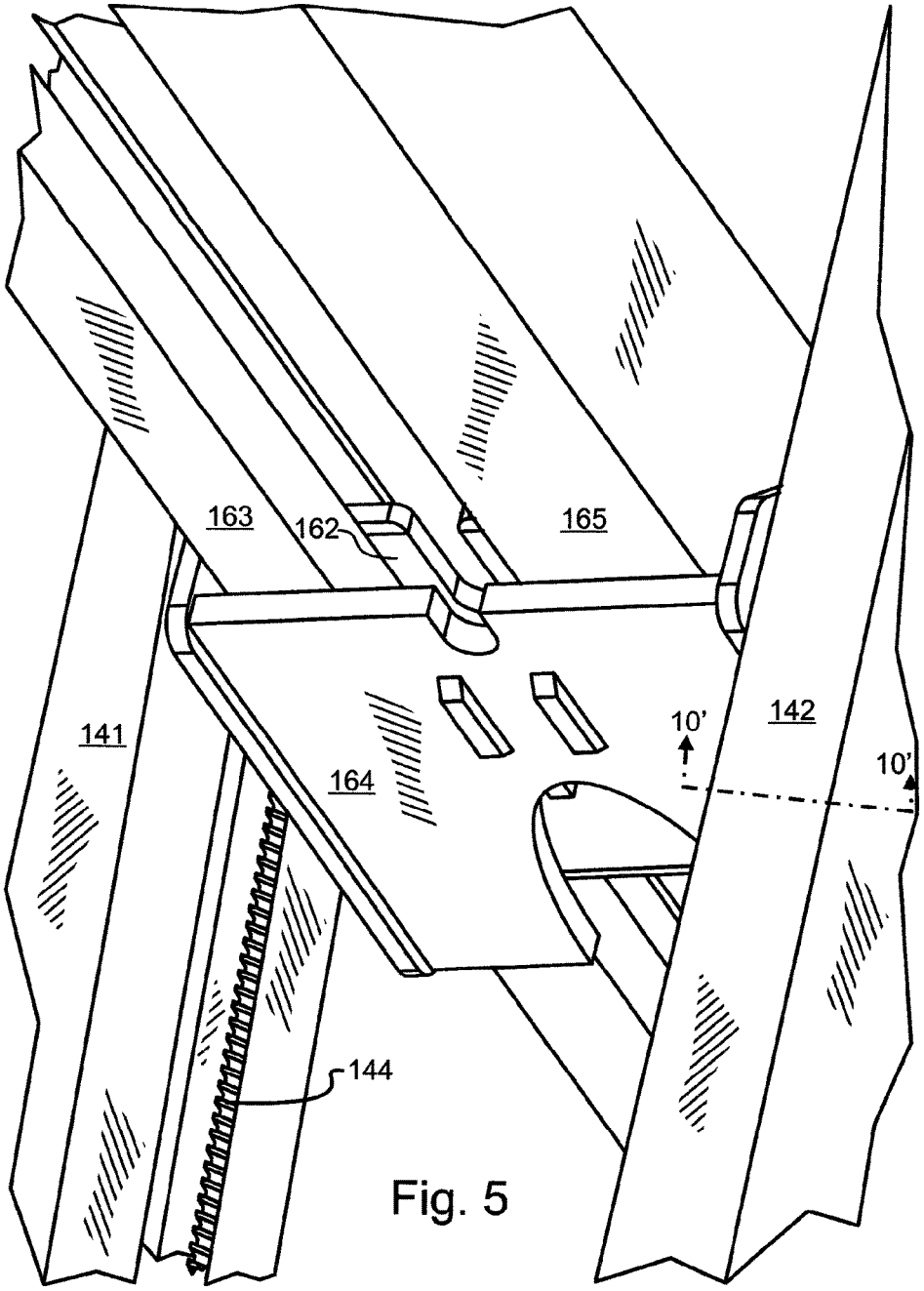
FIG. 5 illustrates a preferred plate and slide coupling the preferred skidway and lift arms of FIG. 2 from underneath, by enlarged and projected view.

Coupling skidway 131 to lift arms 141, 142 through racks 144, 145 is adjustment block 160. Again as best illustrated in FIG. 5, plate 164 and slide 162 sandwich about slide members 163, 165 that are supported and affixed within skidway 130. This arrangement ensures that adjustment block 160 tracks and follows slide members 163, 165. Plate 164 and slide 162 are rigidly coupled to a shaft 166 as best illustrated in FIG. 4. Shaft 166 pivotally passes through toothed locking blocks 168 that have teeth 169 complementary to the teeth on toothed racks 144, 145. Shaft 166 then terminates through rigid coupling with cam lock 167.

Figure 10:
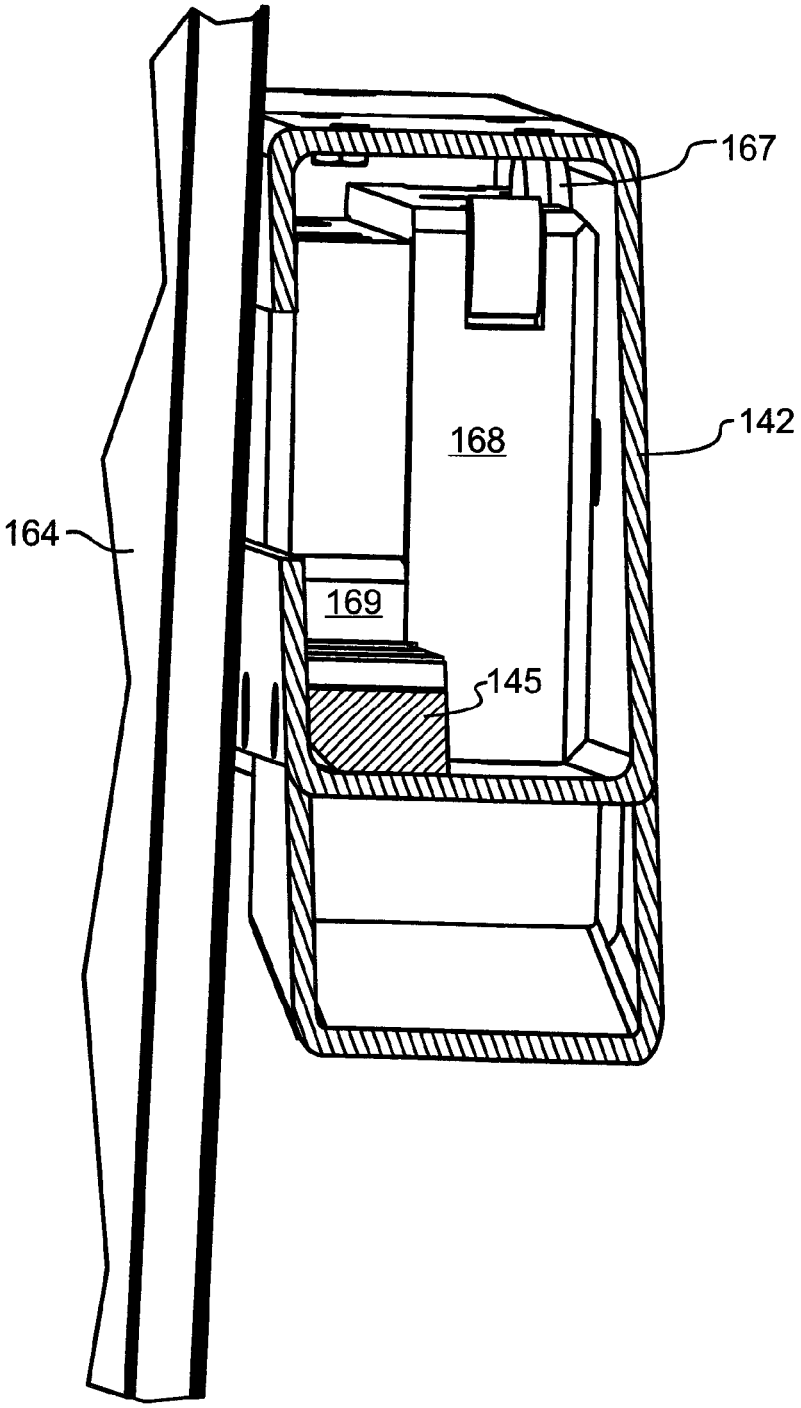
FIG. 10 illustrates a preferred lift arm used in the preferred embodiment pipe handler of FIG. 1 with a cam lock in a locked position, by a section view taken adjacent to a locking block along section line 10' of FIG. 5.

Because of the rigid couplings to shaft 166, cam locks 167 are also rigidly coupled with plate 164 and slide 162. This means that as lift arms 141, 142 rotate relative to skidway 130, the surface of cam locks 167 most nearly adjacent to lift arms 141, 142 changes. By shaping the outer perimeter geometry of cam locks 167 to vary in radial distance from shaft 166, and thereby define a cam surface which changes in radial distance with angular rotation, cam locks 167 will vary from firm contact with the inner wall of lift arms 141, 142 to having a gap there between, depending upon the angular orientation of skidway 130 relative to racks 144, 145. FIG. 10 illustrates a sectional view of lift arm 142 adjacent to locking block 168, with cam lock 167 protruding above locking block 168 (in the orientation of the drawing figure) and thereby engaging the inner wall of lift arm 142. This contact in turn forces locking block 168 downward (again, in the orientation of the drawing figure), which then drives complementary teeth 169 into secure engagement with the teeth of rack 145. Consequently, when in firm contact with the inner wall of lift arms 141, 142, this also means that locking blocks 168 will be forced into locking engagement with racks 144, 145, ensuring that the locking blocks 168 are rigidly coupled to the respective racks 144, 145 by the complementary teeth 169, and can support great strength without inducing relative motion there between. Most preferably, cam locks 167 will be shaped such that at some relatively small angular difference between skidway 130 and racks 144, 145, cam locks 167 will securely engage the inner wall of lift arms 141, 142 and will also lock racks 144, 145 together to locking blocks 168. However, when skidway 130 and racks 144, 145 are parallel, most preferably there will be a gap between cam locks 167 and the inner wall of lift arms 141, 142.

Figure 9:
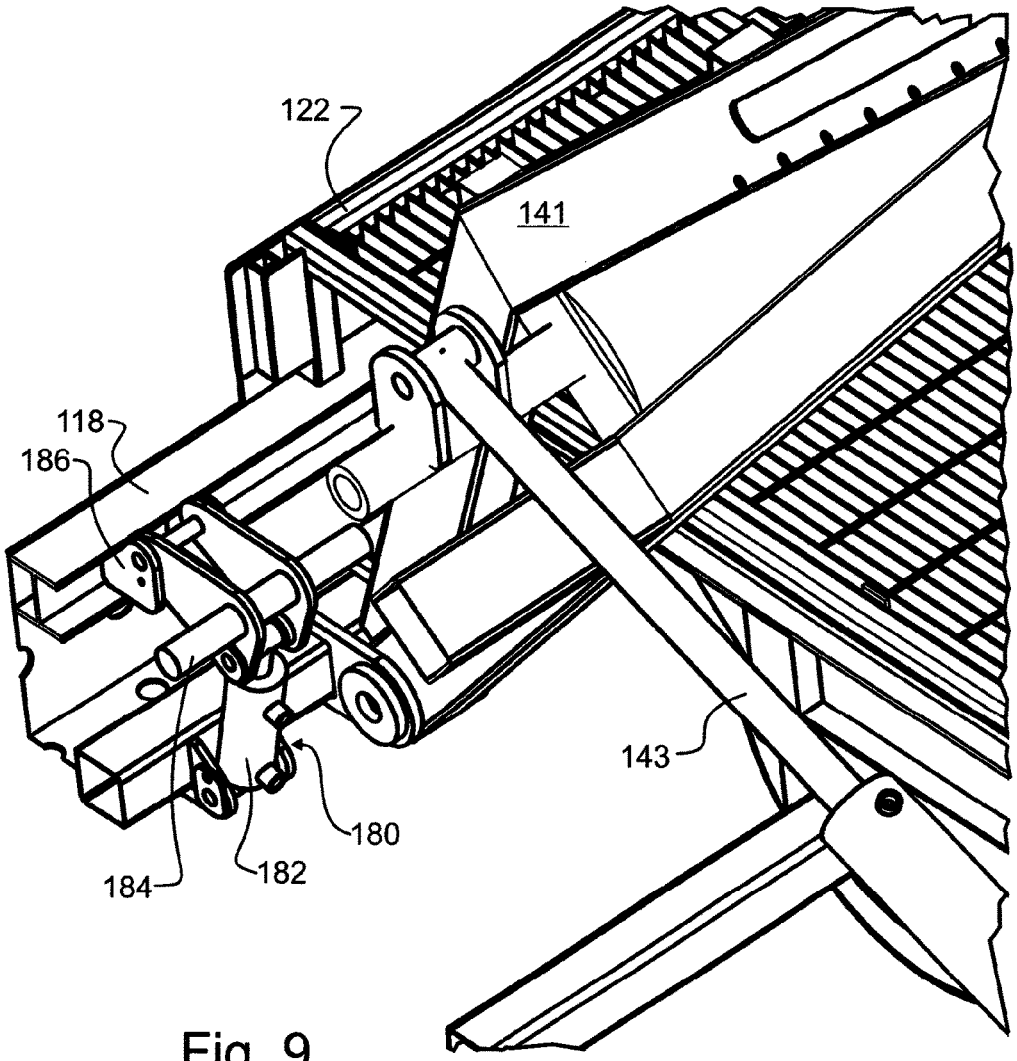
FIG. 9 illustrates the preferred embodiment pipe handler of FIG. 1 illustrating the hydraulic lift cylinder and secondary hydraulic boom unlock cylinder in association with a lift arm, by a vertical and longitudinal section view taken along section line 9' of FIG. 1.

The relative position of locking blocks 168 along racks 144, 145 is adjusted in preferred embodiment pipe handler trailer 100 only when skidway 130 is fully lowered into deck 122, which results in skidway 130 and racks 144, 145 being parallel. Once lowered, then it will be apparent that locking blocks 168 are positioned directly vertically above racks 144, 145. In this position, cam locks 167 are spaced from the inner wall of lift arms 141, 142, allowing locking blocks 168 to be moved vertically away from racks 144, 145. This vertical movement of locking blocks 168 relative to racks 144, 145 is achieved through a secondary unlock actuator 180, visible in FIG. 9. Secondary unlock actuator 180 may as in the preferred embodiment include hydraulic boom unlock cylinder 182 as a source of motive power, and may be located adjacent to lift cylinder 143. A pivotal coupling 186 couples undercarriage 118 to a lifter arm 184 located underneath but in contact with skidway 130 when skidway 130 is fully lowered. Skidway 130 will only be lifted slightly by actuation of hydraulic boom unlock cylinder 182, but sufficiently to lift complementary teeth 169 on adjustment block 160 away and fully separated from racks 144, 145. Next, hydraulic height adjustment cylinder 170, which couples on a first end to skidway 130 and on a second end distal thereto to slide 162 as visible in FIG. 4, may be activated to move adjustment block 160 longitudinally along racks 144, 145 to a new position. When cylinder 170, located within skidway 130 and visible in FIG. 4, is fully retracted, this positions adjustment block 160 closest to the tops of racks 144, 145 in FIG. 4, meaning skidway 130 will be raised to the greatest elevation using boom lift 140. Alternatively, when cylinder 170 is fully extended, this will drive adjustment block 160 towards the bottom of racks 144, 145, which will then result in a lower maximum elevation. Optionally, marks or other appropriate structure corresponding to various platform heights may be provided along one or more of lift arms 141, 142 and skidway 130, so an operator can determine even when skidway 130 and boom lift 140 are fully lowered where to position adjustment block 160 relative to lift arms 141, 142.

In an alternative embodiment to preferred embodiment pipe handler trailer 100 contemplated herein, hydraulically controlled locking blocks such as blocks 268 described herein below are used instead of locking blocks 168. To change the height that skidway 130 reaches, or in other words to adjust pipe handler trailer 100 to a particular derrick platform elevation, lift arms 141, 142 and skidway 130 are fully lowered. This will then trigger a safety switch, detector or the like. When the safety switch is triggered, this in turn allows an operator to release locking blocks 168 from racks 144, 145 through hydraulic or other control Once locking blocks 168 are released, the operator may then activate hydraulic height adjustment cylinder 170 to move adjustment block 160 longitudinally along lift arms 141, 142, simply by retracting or extending hydraulic height adjustment cylinder 170.

Retracting the cylinder will cause adjustment block 160 to be drawn to the end of travel on lift arms 141, 142 and racks 144, 145. When in this position, and when lift arms 141, 142 are subsequently raised by action of hydraulic lift cylinder 143, skidway 130 will reach to the maximum height. To set pipe handler trailer 100 to raise skidway 130 to the minimum height, the operator will lower lift arms 141, 142 and skidway 130, if they are not already lowered, which triggers the safety switch. Then the operator will release locking blocks 168, and next extend hydraulic height adjustment cylinder 170.

The limits of travel of adjustment block 160 along lift arms 141, 142 may be set by travel limit detectors, switches or the like. In addition to, or alternatively, the limits may be set by limits built or incorporated into hydraulic height adjustment cylinder 143.

Figure 6:
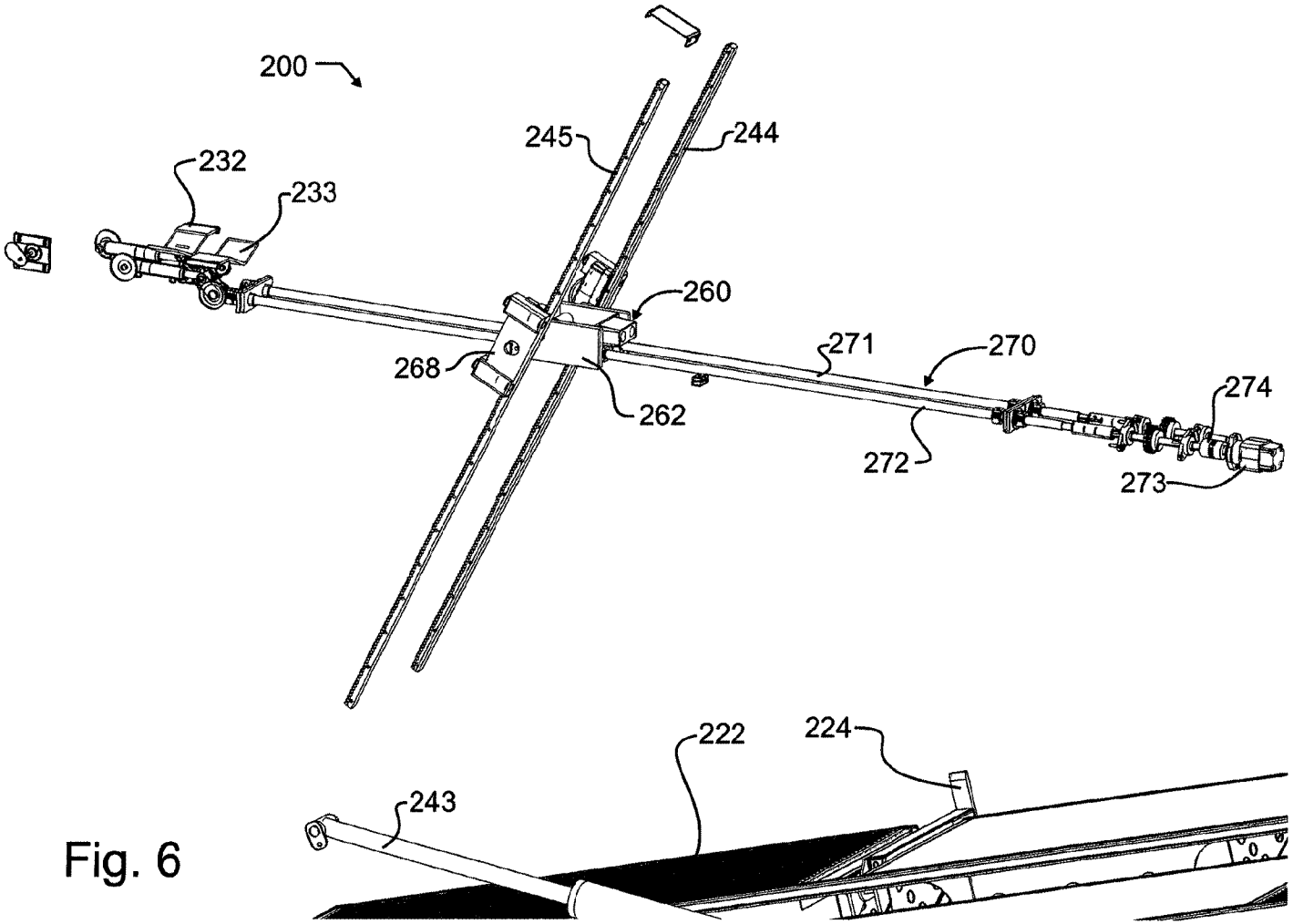
FIG. 6 illustrates an alternative embodiment pipe handler with the exterior components of the skidway and lift arms removed from view to illustrate the internal components therein, taken from a perspective view approximately midway on and slightly elevated above the trailer and viewing from the passenger side thereof.
Figure 7:
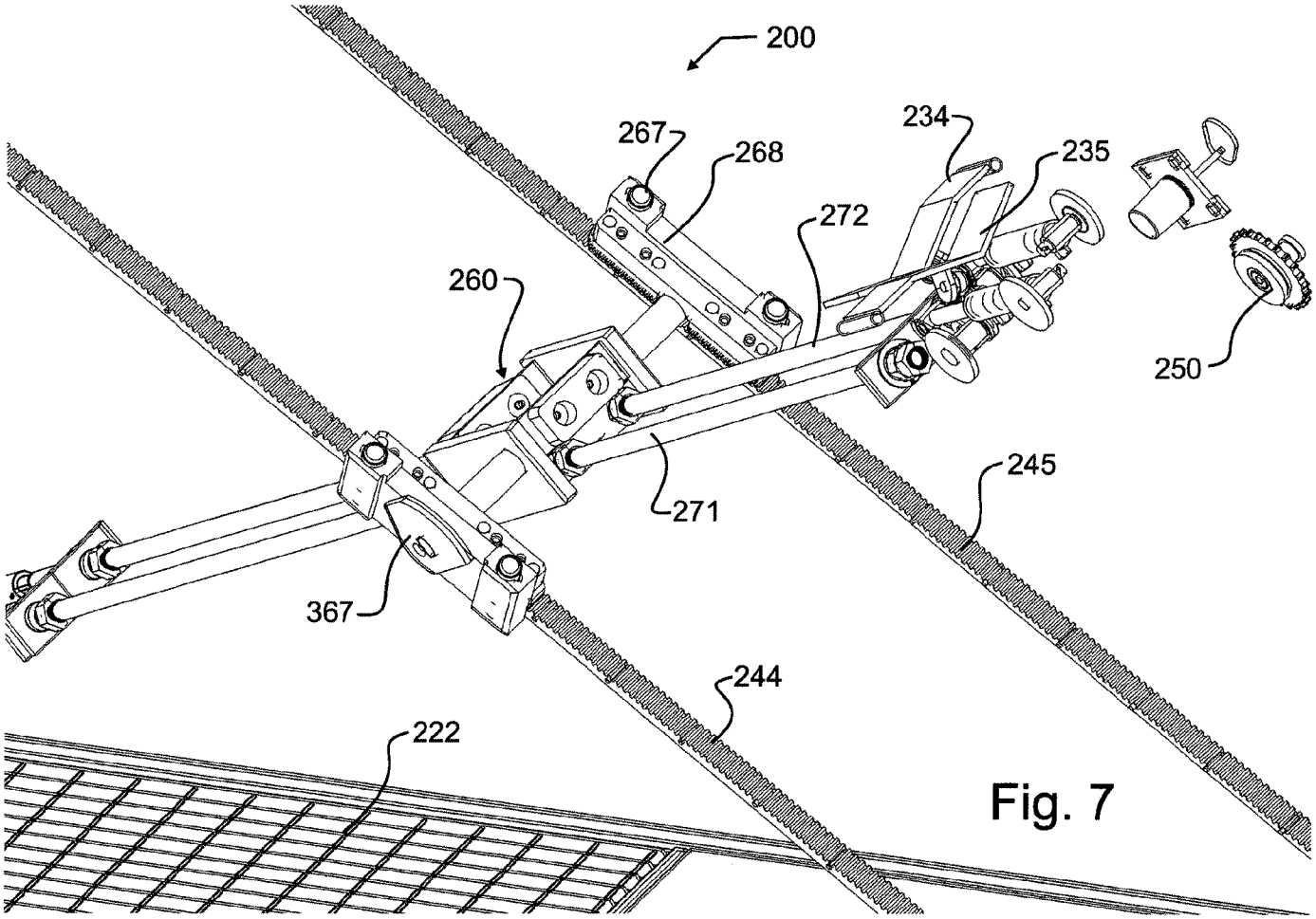
FIG. 7 illustrates the alternative embodiment pipe handler of FIG. 6 from a slightly more enlarged view and rotated about a vertical axis by approximately 180 degrees with respect to the view of FIG. 6, viewing from the driver's side and rear of the trailer, elevated substantially above the trailer.
Figure 8:
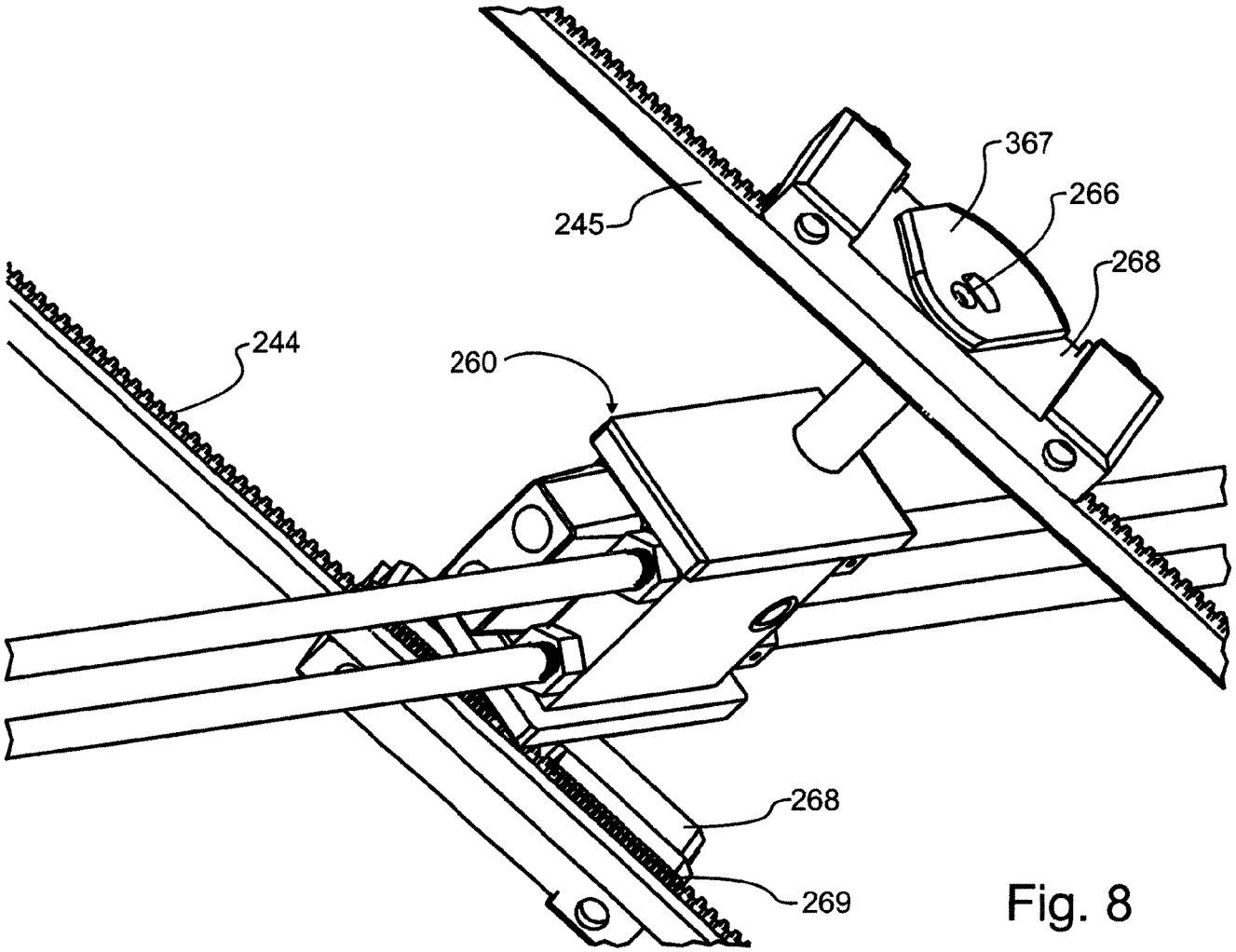
FIG. 8 illustrates the alternative embodiment pipe handler of FIG. 6 from an enlarged perspective view, viewing from the driver's side and center of the trailer, elevated substantially above the trailer and looking upwards under the adjustment block and towards the passenger side rear of the trailer.

An alternative embodiment pipe handler trailer 200 is illustrated in FIGS. 6-8 that has very similar construction to the preferred embodiment pipe handler trailer 100 illustrated in FIGS. 1-5, performs the same function, and includes the same basic structures, such as a wheel set 214, deck 222, supporting framework, skidway 230, and lift arms 241, 242 with racks 244, 245. The two different embodiment pipe handler trailers 100, 200 are distinguished by the hundreds digit, and various components within each embodiment pipe handler are designated by the ones and tens digits. However, many of the components are alike or similar between the two illustrated pipe handler embodiments, so numbering of the ones and tens digits have been maintained wherever possible, such that identical, like or similar components and functions will share the same tens and ones digits between the embodiments, and may more readily be identified and recognized between the embodiments. If not otherwise expressed, those skilled in the art will readily recognize the similarities and understand that in many cases like numbered ones and tens digit components may be substituted from one embodiment to another in accord with the present teachings, except where such substitution would otherwise destroy operation of the embodiment. Consequently, those skilled in the art will readily determine the function and operation of many of the components illustrated herein without unnecessary additional description. Furthermore, where a component is referenced by a particular reference numeral in one embodiment but not explicitly illustrated, it will be understood herein that the reference numeral of the corresponding other embodiment is being referenced. So, for exemplary purposes, since the exterior view of FIG. 1 showing preferred embodiment pipe handler trailer 100 illustrates wheel set 114, and since there is no reference numeral 214 explicitly shown, it will be understood that wheel set 214 is referring to a wheel set identical to wheel set 114, but found on the alternative embodiment pipe handler trailer 200 rather than on the preferred embodiment pipe handler trailer 100.

While many components are identical, as illustrated in FIGS. 6-8 screw adjustment 270 in alternative embodiment pipe handler 200 uses acme screws 271, 272 that are rotated through a hydraulic motor 273 and reversing gear 274 to counter-rotate the screws and thereby to move adjustment block 260, instead of using hydraulic height adjustment cylinder 170. In this alternative embodiment, the acme screws 271, 272 are rotated to extend or retract adjustment block 260 when skidway 230 is fully lowered, similar to but instead of hydraulic cylinder 170 found in preferred embodiment pipe handler 100 of FIGS. 1-5.

Adjustment block 260 has internal threads where acme screws 271, 272 pass through. These internal threads mate with threads on the acme screws 271, 272, and the ends of acme screws 271, 272 are fixed within and relative to skidway 230. Since internal racks 244, 245 are fixed within lift arms 241, 242, rotation of acme screws 271, 272 will apply forces that will cause adjustment block 260 to move relative to the racks.

Before the lift arms 241, 242 are rotated by the hydraulic lift cylinder 243, and while they are fully lowered to a location nearly or fully parallel with deck 222, a switch or the like is triggered that then, and only then, will allow motor 273 coupled to the end of the acme screws 271, 272 to turn. In this embodiment, motor 273 is a hydraulic motor, but other types of motors will be understood to reasonably be substituted therefore. Additional safety and strength in the adjustment assembly may be provided by a pinion gear within locking blocks 268 that rolls on associated racks 244, 245. Locking blocks 268 may also preferably include locking cylinders 267 that otherwise prevent relative movement between adjustment block 260 and internal racks 244, 245. In this alternative embodiment pipe handler trailer 200, locking cylinders 267 perform the function of cam lock 167, but instead of being a cam activated by rotary motion, cylinders may be provided that are hydraulically or otherwise actuated to engage with arms 241, 242, creating the same pressure from that engagement that is generated by cam lock 167. The locking cylinders, for exemplary purpose only and not limiting thereto, may comprise features 269 such as complementary teeth that engage with the teeth on the internal racks 244, 245. These features 269 are ordinarily biased such as through spring, hydraulic, magnetic, gravitational or other force to engage securely with internal racks 244, 245 and prevent relative motion between features 269 and the racks. Only when motive forces are applied or removed to neutralize locking cylinders 267, such as through a hydraulic cylinder, electrical solenoid or other suitable motive power source will the locking cylinders 267 release features 269 from the rack teeth. When the switch is triggered, signifying that skidway 230 has been lowered, then these locking cylinders 267 may also be released to permit this relative movement.

While FIG. 6 solely illustrates locking cylinders 267 in association with locking blocks 268, FIGS. 7 and 8 illustrate a further alternative embodiment comprising both locking cylinders 267 and cam locks 367, either or both which may be utilized to lock locking blocks 268 to racks 244, 245.

When acme screws 271, 272 are rotated, the point at which skidway 230 couples to lift arms 241, 242 through adjustment block 260 will change, and may preferably be adjustable from a lowermost point on the lift arms that is relatively close to deck 222 to a highest point on the lift arms relatively distal to deck 222. The length of the internal racks 244, 245 and the length of acme screws 271, 272 will limit the extent of adjustment available. Since this relative movement changes the height of the skidway 230 end adjacent the rear of the trailer when lift arms 241, 242 are raised, rotating acme screws 271, 272 will adjust the height to a desired target height. Since the height of the drilling platform will vary between different drilling rigs, this permits both the maximum height (perpendicular to the trailer longitudinal axis) that skidway 230 can reach, and the stroke that skidway 230 travels parallel to the trailer 200 longitudinal axis as it is raised and lowered, to be changed through a very large number of positions and settings. By incorporating adequate locking cylinders and safety switches, these height and stroke settings can only be changed when skidway 230 is fully lowered, so that there is no risk of the skidway suddenly dropping during use. Where desired, markings may be provided on skidway 230 that correlate a relative position between the skidway and lift arms 241, 242 to a predetermined maximum height.

While the foregoing details what is felt to be the preferred and alternative embodiments of the invention, no material limitations to the scope of the claimed invention are intended. Further, features and design alternatives that would be obvious to one of ordinary skill in the art are considered to be incorporated herein. The scope of the invention is set forth and particularly described in the claims hereinbelow.

We claim:

1. A pipe handler having a height adjustment assembly to set an adjustable maximum height that a skidway will reach above a deck when a hydraulic lift cylinder is extended, comprising:

a supporting carriage supporting at least a first end of said skidway;

a lift arm pivotally coupled to said supporting carriage adjacent a first terminus and pivotal with respect to said supporting carriage about an axis transverse to a longitudinal axis of said skidway;

an internal rack fixed within said lift arm;

an adjustment block coupling said internal rack to said skidway;

a locking block coupled to said adjustment block and configured to rigidly engage with said internal rack and thereby prevent relative movement of said adjustment block relative to said internal rack when said skidway is displaced from said deck;

a drive operative to reposition said adjustment block longitudinally along said skidway and thereby alter the maximum height that the skidway will reach when said hydraulic lift cylinder is extended.

2. The pipe handler of claim 1, wherein said lift arm further comprises a pair of lift arms and said internal rack further comprises a pair of internal racks, each one of said pair of internal racks fixed within a respective one of said pair of lift arms.

3. The pipe handler of claim 1, wherein said locking block further comprises at least one cylinder.

4. The pipe handler of claim 1, wherein said locking block is configured to disengage from said internal rack when said skidway rests in said bed.

5. The pipe handler of claim 1, further comprising:

a slide configured to slide longitudinally relative to said skidway while maintaining a fixed angular relation thereto;

a cam having a fixed angular relation to said slide and configured to rigidly engage with said lift arm when said skidway is displaced from said deck, and configured to disengage from said lift arm when said skidway rests in said bed.

6. The pipe handler of claim 5, wherein said locking block further comprises teeth complementary to said internal rack, said complementary teeth coupled to said cam and moved by said cam when said cam is rigidly engaged with said lift arm into rigid engagement with said internal rack.

7. The pipe handler of claim 6, further comprising a boom unlock cylinder configured when energized when said skidway rests in said bed to lift said skidway relative to said lift arm and thereby uncouple said complementary teeth from said internal rack.

8. The pipe handler of claim 5, wherein said drive further comprises a hydraulic height adjustment cylinder configured when energized when said skidway rests in said bed to move said slide relative to and longitudinal along said skidway.

9. The pipe handler of claim 5, wherein said drive further comprises an acme screw configured when energized when said skidway rests in said bed to move said slide relative to and longitudinal along said skidway.

10. The pipe handler of claim 5, wherein said cam is rigidly coupled to said slide.

11. A height adjustable pipe handler, comprising:

a supporting carriage supporting at least a first end of said skidway;

a lift arm pivotally coupled to said supporting carriage adjacent a first terminus and pivotal with respect to said supporting carriage about an axis transverse to a longitudinal axis of said skidway;

an adjustment block having a slide coupling said lift arm to said skidway, said slide configured to slide longitudinally relative to said skidway while maintaining a fixed angular relation thereto;

a locking block coupled to said adjustment block and responsive to an angular relationship between said lift arm and said slide configured to rigidly engage with said lift arm when said skidway is displaced from said deck and thereby prevent relative movement of said adjustment block relative to said lift arm;

a drive operative to reposition said adjustment block longitudinally along said skidway and thereby alter the maximum height that the skidway will reach when said hydraulic lift cylinder is extended.

12. The height adjustable pipe handler of claim 11, wherein said locking block further comprises a cam having a fixed angular relation to said slide and configured to rigidly engage with said lift arm when said skidway is displaced from said deck, and configured to disengage from said lift arm when said skidway rests in said bed.

13. The height adjustable pipe handler of claim 11, wherein said drive further comprises a hydraulic height adjustment cylinder configured when energized when said skidway rests in said bed to move said slide relative to and longitudinal along said skidway.

14. The height adjustable pipe handler of claim 11, wherein said drive further comprises an acme screw configured when energized when said skidway rests in said bed to move said slide relative to and longitudinal along said skidway.

15. A locking height adjustable pipe handler having a height adjustment assembly to set an adjustable maximum height that a skidway will reach above a deck when a hydraulic lift cylinder is extended, comprising:

a supporting carriage supporting at least a first end of said skidway;

a lift arm pivotally coupled to said supporting carriage adjacent a first terminus and pivotal with respect to said supporting carriage about an axis transverse to a longitudinal axis of said skidway;

an internal rack fixed within said lift arm;

an adjustment block coupling said internal rack to said skidway;

a locking block coupled to said adjustment block and configured to rigidly engage with said internal rack and thereby prevent relative movement of said adjustment block relative to said internal rack when said skidway is displaced from said deck and further configured to disengage from said internal rack when said skidway rests in said bed;

a drive operative to reposition said adjustment block longitudinally along said skidway and thereby alter the maximum height that the skidway will reach when said hydraulic lift cylinder is extended.

16. The locking height adjustable pipe handler of claim 15, wherein said adjustment block further comprises a slide configured to slide longitudinally relative to said skidway while maintaining a fixed angular relation thereto.

17. The locking height adjustable pipe handler of claim 16, wherein said locking block further comprises a cam having a fixed angular relation to said slide and configured to rigidly engage with said lift arm when said skidway is displaced from said deck, and configured to disengage from said lift arm when said skidway rests in said bed.

18. The locking height adjustable pipe handler of claim 17, wherein said locking block further comprises teeth complementary to said internal rack, said complementary teeth coupled to said cam and moved by said cam when said cam is rigidly engaged with said lift arm into rigid engagement with said internal rack.

19. The locking height adjustable pipe handler of claim 18, further comprising a boom unlock cylinder configured when energized when said skidway rests in said bed to lift said skidway relative to said lift arm and thereby uncouple said complementary teeth from said internal rack.

20. The locking height adjustable pipe handler of claim 19, wherein said drive further comprises a hydraulic height adjustment cylinder configured when energized when said skidway rests in said bed to move said slide relative to and longitudinal along said skidway.

* * * * *